US011703001B2

(12) United States Patent
Dudar

(10) Patent No.: US 11,703,001 B2
(45) Date of Patent: Jul. 18, 2023

(54) SYSTEMS AND METHODS FOR PASSIVE PURGING OF A FUEL VAPOR CANISTER

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/234,279

(22) Filed: Apr. 19, 2021

(65) Prior Publication Data

US 2022/0333537 A1 Oct. 20, 2022

(51) Int. Cl.
*F02D 41/00* (2006.01)
*F02M 25/08* (2006.01)

(52) U.S. Cl.
CPC ..... *F02D 41/004* (2013.01); *F02M 25/0836* (2013.01); *F02D 2200/0602* (2013.01); *F02D 2200/0606* (2013.01); *F02D 2200/701* (2013.01); *F02M 2025/0845* (2013.01); *F02M 2025/0881* (2013.01)

(58) Field of Classification Search
CPC .... F02D 41/00; F02D 41/004; F02D 2200/06; F02D 2200/0602; F02D 2200/0606; F02D 2200/701; F02M 25/08; F02M 25/0836; F02M 25/0845; F02M 25/0881
See application file for complete search history.

(56) References Cited

U.S. PATENT DOCUMENTS

| | | | | |
|---|---|---|---|---|
| 8,495,988 | B2 | 7/2013 | Reddy | |
| 9,050,885 | B1 | 6/2015 | Dudar et al. | |
| 9,145,051 | B2 | 9/2015 | Dudar et al. | |
| 2003/0196645 | A1* | 10/2003 | Kojima | F02M 25/089 123/520 |
| 2009/0084363 | A1* | 4/2009 | Reddy | F02M 27/08 903/902 |
| 2010/0252006 | A1 | 10/2010 | Reddy | |
| 2017/0082043 | A1* | 3/2017 | Dudar | F01N 3/103 |
| 2017/0204796 | A1* | 7/2017 | Dudar | F02M 25/089 |
| 2017/0226967 | A1* | 8/2017 | Dudar | B60K 15/035 |
| 2018/0058384 | A1* | 3/2018 | Dudar | F02D 41/221 |
| 2018/0066595 | A1* | 3/2018 | Dudar | F02M 25/0818 |

* cited by examiner

*Primary Examiner* — John Kwon
*Assistant Examiner* — Johnny H Hoang
(74) *Attorney, Agent, or Firm* — Vincent Mastrogiacomo; McCoy Russell LLP

(57) ABSTRACT

Methods and systems are provided for reverse purging of a fuel vapor canister of an engine. In one example, a method may include heating a fuel vapor canister, sealing a fuel tank in order to generate a vacuum in the fuel tank, and in response to the pressure in the fuel tank reaching a target vacuum, initiating reverse purging of the fuel vapor canister.

7 Claims, 6 Drawing Sheets

SYSTEMS AND METHODS FOR PASSIVE PURGING OF A FUEL VAPOR CANISTER

FIELD

The present description relates generally to methods and systems for heating a fuel vapor canister of an evaporative emissions control system in order to facilitate passive purging of the fuel vapor canister.

BACKGROUND/SUMMARY

Vehicle emission control systems may be configured to store fuel vapors from fuel tank refueling and diurnal engine operations in a fuel vapor canister containing an adsorbent, such as activated carbon. The stored vapors may then be purged from the fuel vapor canister during a subsequent engine operation. The purged vapors may be routed to the engine intake for combustion, further improving vehicle fuel economy.

Fuel vapor canister purging includes desorption of hydrocarbons from the adsorbent contained therein. As such, a hot fuel vapor canister may have an increased ability to desorb fuel vapor. Therefore, heating the adsorbent may be employed as a strategy to promote desorption and increase purge efficiency. A canister heater may directly heat the adsorbent, may heat the exterior of the fuel vapor canister, and/or may heat purge air passing through the fuel vapor canister.

In order to facilitate cleaning of the vapor fuel canister for continued operation, the fuel vapor canister may be opportunistically purged in a passive manner (also referred to herein as reverse purging) to reduce the canister load. Reverse purging may occur during a cool-down (or heat loss) portion of a diurnal ambient temperature cycle. As fuel vapors in the tank cool and condense back into liquid during the cool-down portion of the diurnal ambient temperature cycle, a vacuum may be formed in the fuel tank. A variable bleed valve (VBV) regulating fluid coupling between the canister and the fuel tank may be opened, causing fresh air to be pulled into the fuel vapor canister via a fresh air port, thus purging the contents of the canister into the fuel tank. During passive purging, the activated carbon adsorbent may have insufficient heat to desorb fuel vapors into the fuel tank, and heating assistance via the canister heater may allow for a more efficient desorption process. However, conventional passive purging operates during an engine-off state, and therefore a strategy for activating the heater after an engine-off state for passive purging is desirable.

One example approach for applying canister heating for purging of a vapor fuel canister after a key-off event is shown by Reddy in U.S. Patent Application No. 2013/8495988. Therein, an extended range hybrid vehicle includes an evaporative emissions (EVAP) system containing a first vapor storage device, a second vapor storage device, the latter of which may be physically and thermally coupled to a heat exchanging element, and a three-way valve, which may fluidly couple each of the first vapor storage device, the second vapor storage device and a fuel tank. Additionally, the second vapor storage device is fluidly coupled to the atmosphere via a canister vent solenoid (CVS) valve.

After a key-off event, and connection of the vehicle to the external power supply, the method shown by Reddy may determine if an energy storage device (ESD) is operable based on engine operation since the last charging event of the ESD. In response to a determination that the engine did not operate since the last recharging event, the method may proceed to close the CVS valve, adjust the three-way valve for flow between the second vapor storage device and the fuel tank, and heat the second vapor storage device for a pre-determined time via the heat exchanging element. In response to the heating of the second vapor storage device, hydrocarbons stored therein may desorb from the adsorbent and be purged into the fuel tank. Following the pre-determined heating time, the heat exchanging element may be turned off, the three-way valve may be switched to couple the first and second vapor storage devices, and the CVS valve may be opened.

However, the inventors herein have recognized potential issues with such systems. As one example, the method of Reddy may be restricted for extended range hybrid vehicles, which may be dependent on an external power source for heating the vapor storage device. This may reduce applicability for hybrid vehicles which do not couple to an external power source. Also, by initiating reverse purge during conditions when the fuel tank may be warm (such as due to ambient temperature), sufficient vacuum may not be available at the fuel tank for effective routing of fuel vapor desorbed at the canister. Since fuel vapor canisters are designed and sized taking into account occurrence of reverse purging, in absence of sufficient reverse purging, excess fuel vapor at the canister may escape to the atmosphere, thereby adversely affecting emissions quality.

In one example, the issues described above may be addressed by a method heating the fuel vapor canister and sealing the fuel tank prior to an upcoming engine-off condition, and in response to a pressure in the fuel tank reducing to a first threshold pressure, initiating reverse purging of the fuel vapor canister. In this way, a canister heating strategy may be used in conjunction with ambient temperature conditions to enable efficient reverse purging of the vapor fuel canister.

As an example, diurnal changes in temperature may be used to enable effective purging of the canister. Upon a possibility of an imminent engine-off event, during a higher than threshold load in the fuel vapor canister, the ambient temperature may be monitored and compared to a fuel temperature. If the ambient temperature is determined to be below the fuel temperature, it may be inferred that upon engine shut-down, fuel vapors in the fuel tank may begin to condense into liquid, generating a vacuum within the fuel tank. After determining that the ambient temperature is below the fuel temperature, the canister heater may be preemptively turned on or maintained in operation before the imminent engine-off event, which may prepare the canister for reverse purging after the engine shut-down is completed. After the engine-off event, the powertrain control module (PCM) may be maintained on to implement reverse purging of the contents of the fuel vapor canister into the fuel tank, until the load of the vapor canister is reduces to a relatively lower load threshold.

During an engine-off condition, the ambient temperature may be monitored to determine a maxima in the diurnal ambient temperature cycle via an ambient temperature sensor in conjunction with weather data (such as obtained via remote access to the internet through a cloud). When the ambient temperature is determined to be at a maxima of the diurnal ambient temperature cycle and it is determined that there is adequate charge in an onboard battery to power the PCM, the method may proceed to switch on the PCM in order to heat the fuel vapor canister. The fuel vapor canister may be heated for a duration based on the ambient temperature maxima and the diurnal ambient temperature cycle.

After sufficient vacuum is developed in the fuel tank due to the cooling ambient temperature, the PCM may initiate reverse purging of the content of the fuel vapor canister to the fuel tank by actuation of fuel system valves until the load of the fuel tank canister reduces to the lower load threshold. If the lower load threshold is not achieved, the cycle may repeat in conjunction with the diurnal ambient temperature cycle.

In this way, by utilizing the diurnal ambient temperature to reverse purge the fuel vapor canister in conjunction with a canister heating strategy, the fuel vapor canister may be purged in an efficient manner. The technical effect of opportunistically heating the fuel vapor canister immediately prior to developing sufficient vacuum in the fuel tank is that more efficient desorption during reverse purging of the fuel vapor canister may be achieved. The methods described herein may also allow for broader use for canister heating strategies outside of use in extended range hybrid vehicles. Additionally, the reverse purging of the fuel vapor canister may allow for more efficient use of the EVAP system and greater longevity of the fuel vapor canister. Further, an efficient reverse purging strategy may be a consideration in the design of the EVAP system, whereby a smaller canister may be used, which may further reduce material weight and cost.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 4:
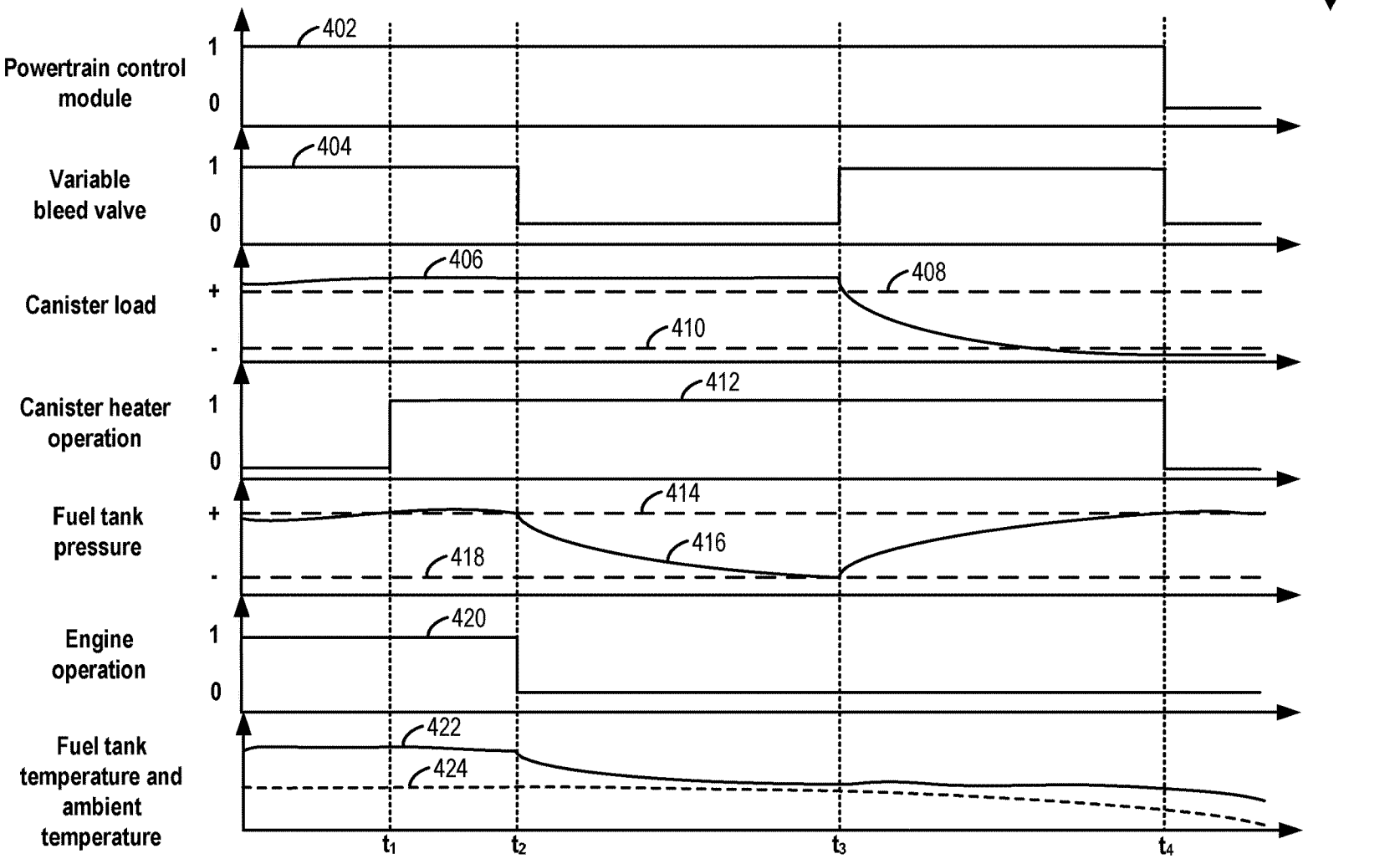
FIG. 4 shows an example timeline for heating the vapor fuel canister before an engine-off event to enable a subsequent reverse purging event, according to the present disclosure.
Figure 5:
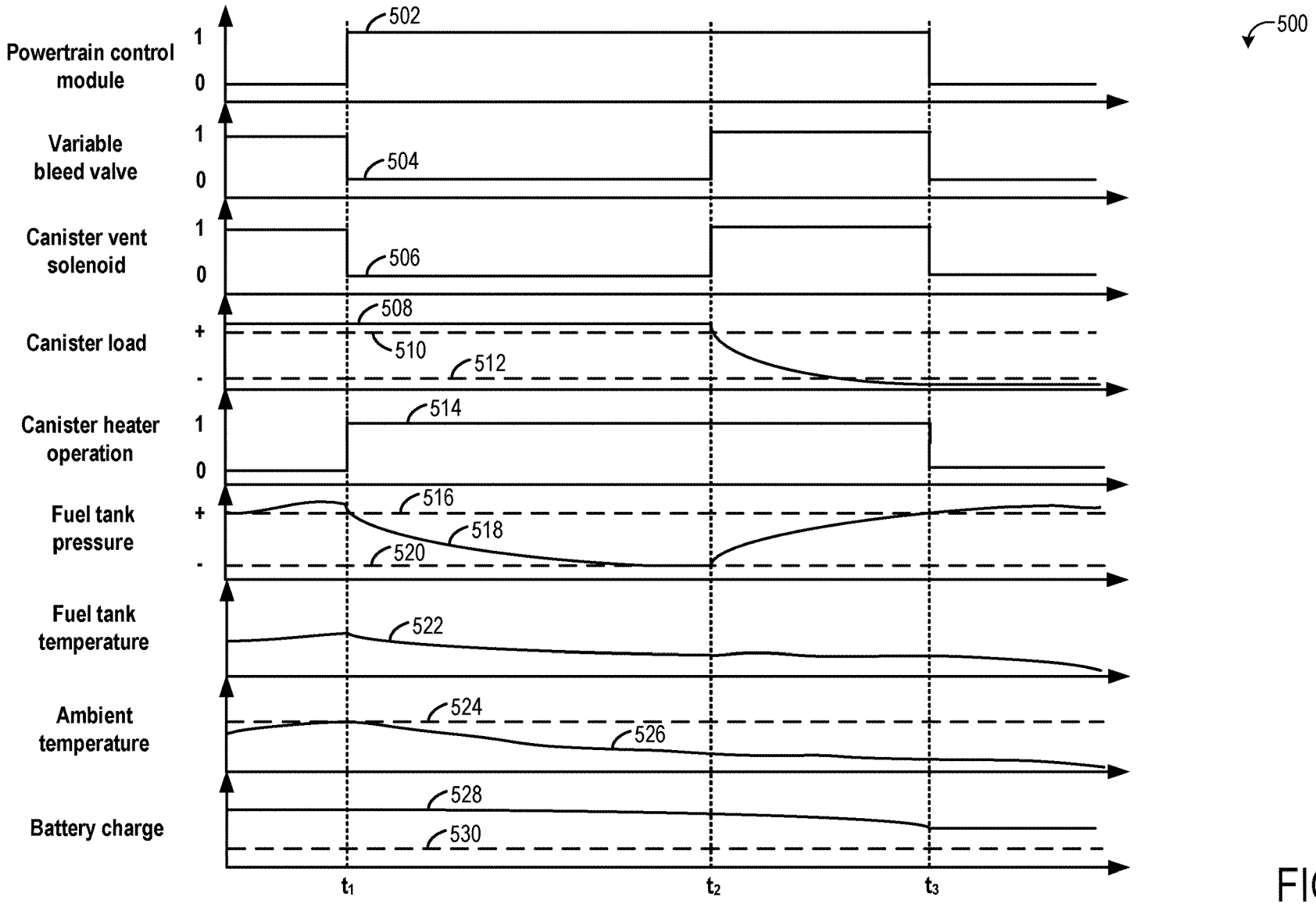
FIG. 5 shows an example timeline for heating the vapor fuel canister after an engine-off event to enable a subsequent reverse purging event, according to the present disclosure.

The following description relates to systems and methods for heating a vapor fuel canister in conjunction with a diurnal ambient temperature cycle, to facilitate efficient reverse purging of the vapor fuel canister. Such methods may be executed on a hybrid vehicle propulsion system, which contains an engine system coupled to a fuel system and an EVAP system, shown schematically in FIG. 1. An engine controller may be configured to perform a control routine, such as the example routine of FIGS. 2A-3 for heating the vapor fuel canister before and after an engine-off event, respectively, in order to facilitate efficient reverse purging of the vapor fuel canister Examples of canister reverse purging in conjunction with canister heating before and after engine-off events are shown in FIGS. 4-5, respectively.

Figure 1:
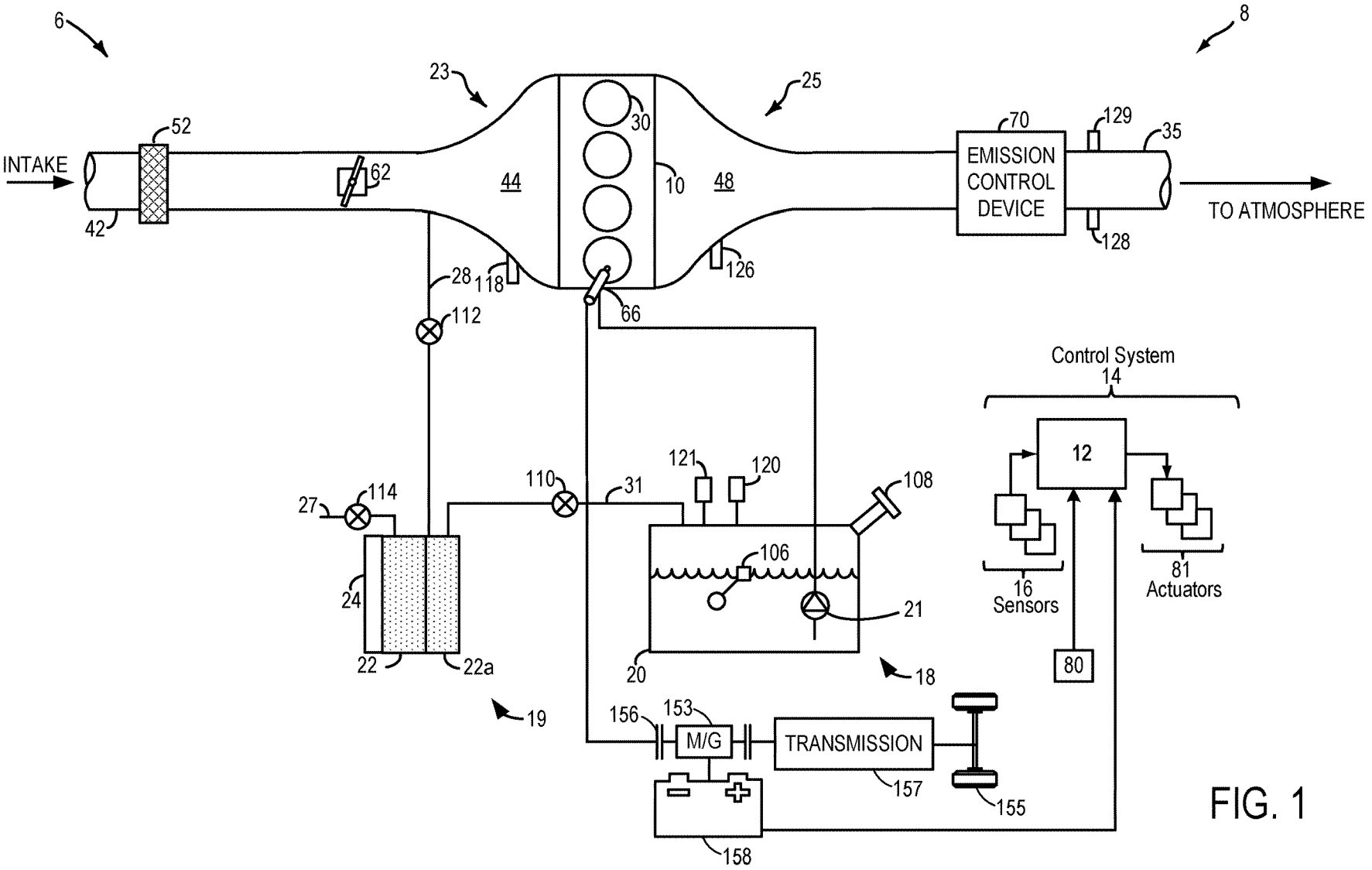
FIG. 1 schematically shows an example vehicle system with a fuel system and an evaporative emissions system.

FIG. 1 shows a schematic depiction of a vehicle system 6 that can derive propulsion power from engine system 8 and/or an on-board energy storage device, such as a battery 158. An energy conversion device, such as electric machine 153, may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to an evaporative emissions (EVAP) system 19, and a fuel system 18. EVAP system 19 includes a fuel vapor canister 22. Fuel system 18 includes a fuel tank 20 coupled to a fuel pump 21 and the fuel vapor canister 22. During a fuel tank refueling event, fuel may be pumped into the vehicle from an external source through a refueling assembly 108. The refueling assembly 108 and the fuel tank 20 may be in fluidic communication via a fuel passage 160. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to a controller 12. As depicted, fuel level sensor 106 may comprise a float connected to a variable resistor. Alternatively, other types of fuel level sensors may be used. Refueling assembly 108 may include a number of components configured to enable cap-less refueling, decrease air entrapment in the assembly, decrease the likelihood of premature nozzle shut-off during refueling, as well as increase the pressure differential in the fuel tank over an entire refueling operation, thereby decreasing the duration of refueling.

Fuel pump 21 is configured to pressurize fuel delivered to the injectors of engine 10, such as fuel injector 66. While a single fuel injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via fuel vapor line 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single fuel vapor canister 22 is shown, it will be appreciated that fuel system 18 may include any number of canisters. In one example, canister purge valve 112 may be a solenoid valve wherein opening or closing of the valve is performed via actuation of a canister purge solenoid.

Fuel vapor canister 22 may include a buffer 22*a* (or buffer region), each of the canister and the buffer containing the adsorbent. As shown, the volume of buffer 22*a* may be smaller than (e.g., a fraction of) the volume of fuel vapor canister 22. The adsorbent in the buffer 22*a* may be same as, or different from, the adsorbent in the canister (e.g., both may include charcoal). Buffer 22*a* may be positioned within fuel vapor canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of fuel vapor spikes going to the engine.

Fuel vapor canister 22 includes a vent line 27 for routing gases out of the fuel vapor canister 22 to the atmosphere when storing, or trapping, fuel vapors from fuel tank 20. Vent line 27 may also allow fresh air to be drawn into fuel vapor canister 22 when purging stored fuel vapors to engine intake 23 via purge line 28 and canister purge valve 112. While this example shows vent line 27 communicating with fresh, unheated air, various modifications may also be used. Vent line 27 may include a canister vent solenoid (CVS) valve 114 to adjust a flow of air and vapors between fuel vapor canister 22 and the atmosphere, wherein opening or closing of the valve is performed via actuation of a canister vent solenoid. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In some examples, an air filter may be coupled in vent line 27 between CVS valve 114 and atmosphere.

Further, one or more canister heaters 24 may be coupled to and/or within fuel vapor canister 22. As fuel vapor is adsorbed by the adsorbent in the canister, heat is generated, herein also referred to as "heat of adsorption" Likewise, as fuel vapor is desorbed by the adsorbent in the canister, heat is consumed. Canister heater 24 may be used to selectively heat the canister (and the adsorbent contained within) for example, to increase desorption of fuel vapors prior to performing a purge operation. Canister heater 24 may comprise an electric heating element, such as a conductive metal, ceramic, or carbon element that may be heated electrically, such as a thermistor. In some embodiments, canister heater 24 may comprise a source of microwave energy, or may comprise a canister jacket coupled to a source of hot air or hot water. Canister heater 24 may be coupled to one or more heat exchangers that may facilitate the transfer of heat, (e.g., from hot exhaust) to fuel vapor canister 22. Canister heater 24 may be configured to heat air within fuel vapor canister 22, and/or to directly heat the adsorbent located within fuel vapor canister 22. In some embodiments, canister heater 24 may be included in a heater compartment coupled to the interior or exterior of fuel vapor canister 22. In some embodiments, fuel vapor canister 22 may be coupled to one or more cooling circuits, and/or cooling fans. In this way, fuel vapor canister 22 may be selectively cooled to increase adsorption of fuel vapors (e.g., prior to a refueling event). In some examples, canister heater 24 may comprise one or more Peltier elements, which may be configured to selectively heat or cool fuel vapor canister 22.

As such, vehicle system 6 may have reduced engine operation times due to the vehicle being powered by engine system 8 during some conditions, and by the energy storage device, such as battery 158, under other conditions. While the reduced engine operation times reduce overall carbon emissions from the vehicle, they may also lead to insufficient purging of fuel vapors from the vehicle's emission control system. To address this, a variable bleed valve (VBV) 110 may be optionally included in fuel vapor line 31 such that fuel tank 20 is coupled to fuel vapor canister 22 via the VBV 110. During regular engine operation, VBV 110 may be kept closed to reduce the amount of diurnal or "running loss" vapors directed to fuel vapor canister 22 from fuel tank 20. During refueling operations, and selected purging conditions, VBV 110 may be temporarily opened, e.g., for a duration, to direct fuel vapors from the fuel tank 20 to fuel vapor canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister 22 and the fuel tank pressure may be maintained below pressure limits. While the depicted example shows VBV 110 positioned along fuel vapor line 31, in alternate embodiments, the VBV may be mounted on fuel tank 20.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and fuel vapor canister 22, specifically between the fuel tank and VBV 110. In still other embodiments, a first pressure sensor may be positioned upstream of the VBV (between the VBV and the canister) while a second pressure sensor is positioned downstream of the VBV (between the VBV and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and fuel vapor canister 22.

Fuel vapors released from fuel vapor canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be useful if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to engine intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 and EVAP system 19 may be operated by controller 12 in a plurality of modes by selective adjustment of the various valves and solenoids. For example, fuel system 18 and EVAP system 19 may be operated in a fuel vapor storage mode (e.g., during a fuel tank refueling operation and with the engine not running), wherein the controller 12 may open VBV 110 and CVS valve 114 while closing canister purge valve 112 to direct refueling vapors into fuel vapor canister 22 while preventing fuel vapors from being directed into the intake manifold.

As another example, fuel system 18 and EVAP system 19 may be operated in a refueling mode (e.g., when fuel tank refueling is requested by a vehicle operator), wherein the controller 12 may open VBV 110 and CVS valve 114, while maintaining canister purge valve 112 closed, to depressurize the fuel tank before allowing enabling fuel to be added therein. As such, VBV 110 may be kept open during the refueling operation to allow refueling vapors to be stored in fuel vapor canister 22. After refueling is completed, the VBV 110 may be closed.

As yet another example, fuel system 18 and EVAP system 19 may be operated in an active canister purging mode (e.g., after an emission control device light-off temperature has been attained and with the engine running), wherein the controller 12 may open canister purge valve 112 and canister vent valve while closing VBV 110. Herein, the vacuum generated by the intake manifold of the operating engine may be used to draw fresh air through vent line 27 and through fuel vapor canister 22 to purge the stored fuel vapors into engine intake manifold 44. Additionally, active purging may be made more efficient via the canister heater 24. In this mode, the purged fuel vapors from the canister are combusted in the engine. The purging may be continued until the stored fuel vapor amount in the canister is below a threshold. As an example, the threshold may be 10% of canister load capacity. During active purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. Additionally, the fuel vapor canister 22 may be purged into the fuel tank 20 via reverse purging, to be discussed further therein.

Reverse purging may be initiated by a system for an engine 10 in a vehicle system 6 with a controller 12 with computer-readable instructions stored on non-transitory memory. Upon conditions for reverse purging of a fuel vapor canister of an EVAP system 19 being met, the VBV 110 may be actuated to a closed position, the canister heater 24 coupled to the fuel vapor canister 22 may be switched on to desorb fuel vapor stored in the fuel vapor canister 22, and in response to a pressure in the fuel tank 20 reducing to below a threshold pressure, the VBV 110 may be opened, routing ambient air to the fuel tank 20 via a vent line 27 of the EVAP system 19 and the fuel vapor canister 22, where the ambient air may route desorbed fuel vapor to the fuel tank 20.

In particular, in anticipation of an upcoming engine-off event, the fuel vapor canister 22 may be heated, and the fuel tank 20 may be sealed, and in response to a pressure in the fuel tank 20 reducing to a first threshold pressure which is less than atmospheric pressure, reverse purging of the fuel vapor canister 22 may be initiated. Heating of the fuel vapor canister 22 may be carried out via operation of a canister heater 24 upon conditions for reverse purging being met, the conditions including the temperature of the fuel tank 20 being higher than an ambient temperature and a fuel vapor load within the fuel vapor canister 22 being higher than a threshold load. As part of the fuel tank 20 sealing, the VBV 110, which couples to a fuel vapor line 31 connecting the fuel vapor canister 22 to the fuel tank 20, may be closed. After the engine-off event, the VBV 110 may be reopened to initiate reverse purging. Opening the VBV 110 may draw in air into the fuel tank 20 via the vent line 27 and the heated fuel vapor canister 22, where the air may desorb fuel vapor from the heated fuel vapor canister 22 and route the desorbed fuel vapor to the fuel tank 20.

Due to the reverse purging of the fuel vapor canister 22, the pressure in the fuel tank 20 may consequently increase. The pressure in the fuel tank 20 may increase to above a second threshold pressure, where the second threshold pressure is higher than the first threshold pressure and a function of atmospheric pressure, and the fuel vapor load within the fuel vapor canister 22 may remain higher than the threshold load. In response to such conditions, heating of the fuel vapor canister 22 may be maintained, the fuel tank 20 may be resealed. Due to sealing of the fuel tank 20, the pressure in the fuel tank 20 may again reduce to the first threshold pressure, and reverse purging of the fuel vapor canister 22 may be repeated. Upon carrying out reverse purging one or more times, the load within in fuel vapor canister may be reduced to below the threshold load, the canister heater 24 may be deactivated, and the VBV 110 maintained open.

Alternatively, the method may operate the canister heater 24 during an engine-off condition upon an ambient temperature increasing to a maximum temperature of a diurnal cycle during the higher than threshold canister loading. Heating of the fuel vapor canister 22 may involve closing each of the VBV 110 and the CVS valve 114 coupled to vent line 27. In response to the pressure in the fuel tank reducing to the first threshold pressure, the VBV 110 and the CVS valve 114 may be opened, initiating reverse purging of the fuel vapor canister 22. During reverse purging of the fuel vapor canister 22, the pressure in the fuel tank 20 may increase to second threshold pressure during the higher than threshold canister loading. In response to such conditions, the fuel tank 20 may be resealed, and upon the pressure in the fuel tank reducing to the first threshold pressure, the fuel tank 20 may be unsealed, and reverse purging of the fuel vapor canister 22 may be repeated.

In this way, by opportunistically using the diurnal change in ambient temperature in conjunction with heating of the fuel vapor canister 22 either before an engine-off event or after an engine-off event, reverse purging of the fuel vapor canister 22 may be enhanced.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. As another example, the actuators may include fuel injector 66, VBV 110, canister purge valve 112, CVS valve 114, fuel pump 21, and air intake throttle 62.

Control system 14 may further receive information regarding the location of the vehicle from an on-board global positioning system (GPS) 80. Information received from the GPS 80 may include vehicle speed, vehicle altitude, vehicle position, etc. This information may be used to infer engine operating parameters, such as local barometric pressure. Control system 14 may further be configured to receive information via the internet or other communication networks (such has via remote access to the internet through a cloud). Information received from the GPS 80 may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be powered through onboard stored energy via battery 158. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. Example control routines are described herein with regard to FIGS. 2A-B and FIG. 3.

In some examples, vehicle system 6 may be a hybrid vehicle with multiple sources of torque available to one or more vehicle wheels 155. In other examples, vehicle system 6 is a conventional vehicle with an engine, or an electric vehicle with electric machine(s). In the example shown, vehicle system 6 includes engine 10 and an electric machine 153. Electric machine 153 may be a motor or a motor/generator. Crankshaft 140 of engine 10 and electric machine 153 are connected via a transmission 157 to vehicle wheels 155 when one or more clutches 156 are engaged. In the depicted example, a first clutch 156 is provided between crankshaft 140 and electric machine 153, and a second clutch 156 is provided between electric machine 153 and transmission 157. Controller 12 may send a signal to an actuator of each clutch 156 to engage or disengage the clutch, so as to connect or disconnect crankshaft 140 from electric machine 153 and the components connected thereto, and/or connect or disconnect electric machine 153 from transmission 157 and the components connected thereto. Transmission 157 may be a gearbox, a planetary gear system, or another type of transmission. The powertrain may be configured in various manners including as a parallel, a series, or a series-parallel hybrid vehicle.

Electric machine 153 receives electrical power from battery 158 to provide torque to vehicle wheels 155. Electric machine 153 may also be operated as a generator to provide electrical power to charge battery 158, for example during a braking operation.

Figure 2A:
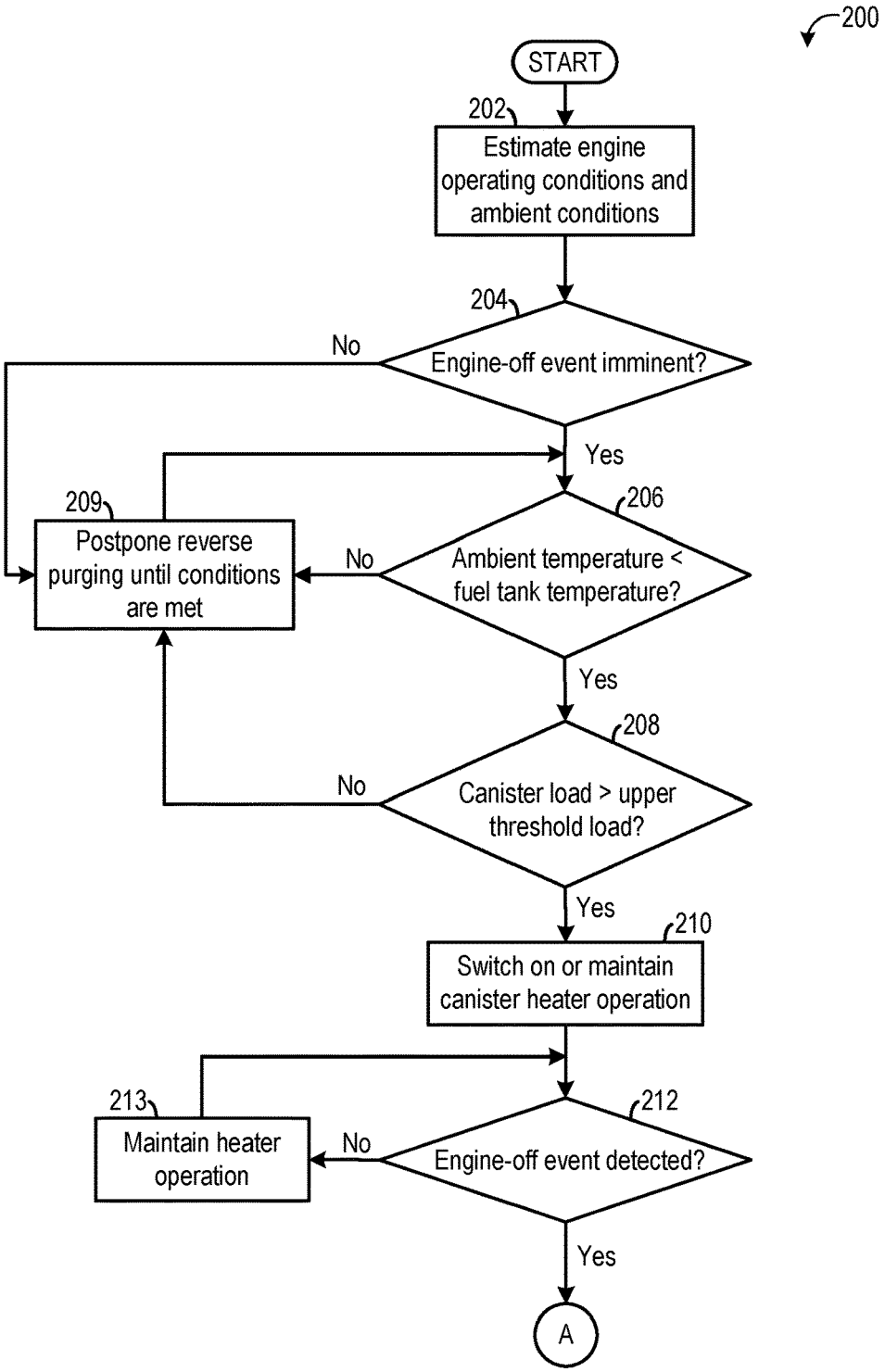
FIGS. 2A, 2B shows a flowchart of an example method for heating a vapor fuel canister before an engine-off event to facilitate reverse purging of a fuel vapor canister.
Figure 2B:
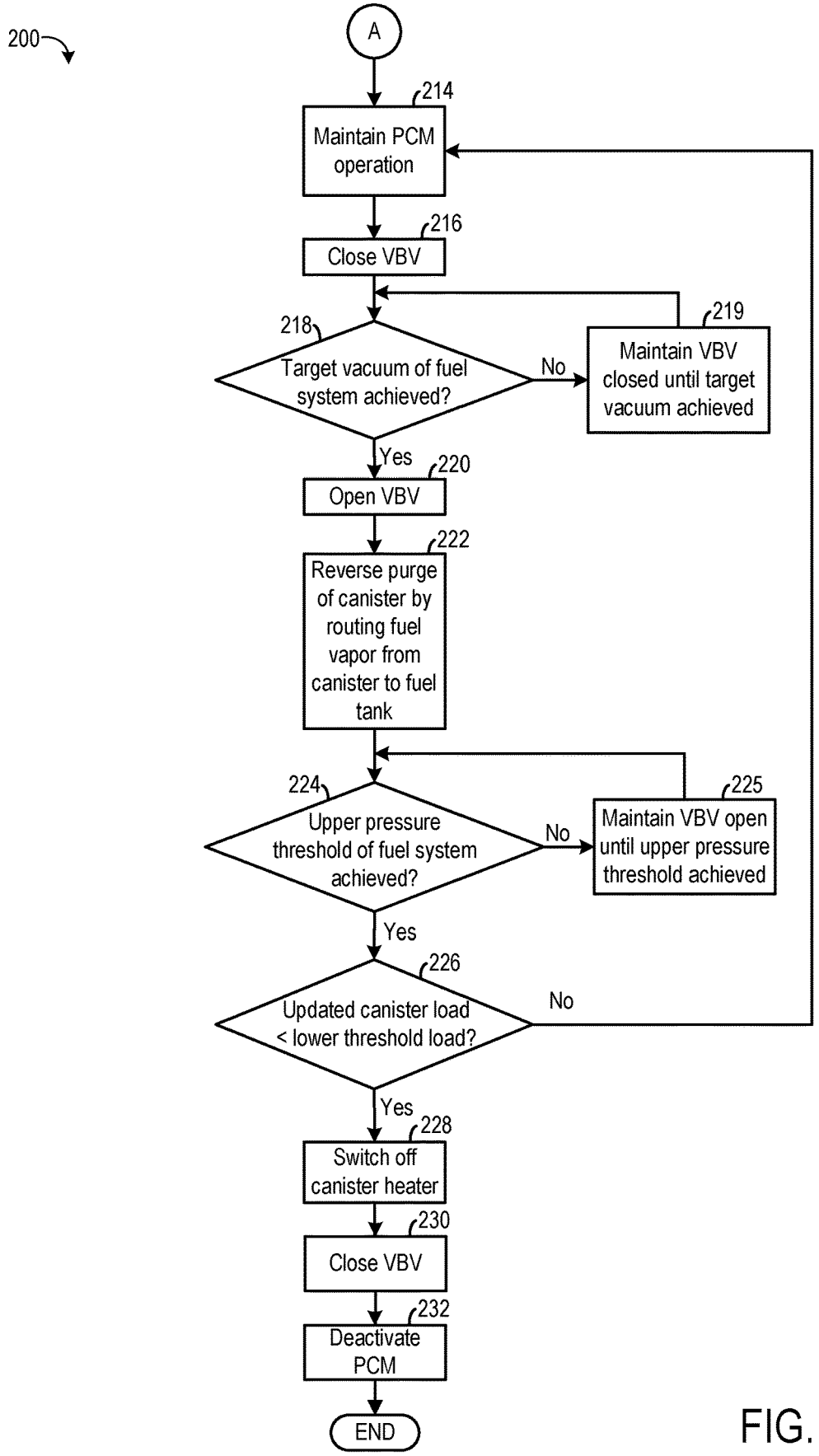

FIGS. 2A-2B shows a method 200 for heating a vapor fuel canister (such as fuel vapor canister 22 of FIG. 1) before an engine-off event to facilitate reverse purging of the fuel vapor canister. Method 200 and all other method described herein will be described in reference to the systems described herein and with regard to FIG. 1, but it should be understood that similar methods may be applied to other systems without departing from the scope of this disclosure. Method 200 and all other method described herein may be carried out by control system 14, and may be stored at controller 12 in non-transitory memory. Instructions for carrying out method 200 and all other method described herein may be executed by the controller 12 in conjunction with signals received from sensors of an engine system of the vehicle, such as the sensors described above with reference to FIG. 1. The controller may employ engine actuators of the engine system to adjust operation of an engine of the vehicle, according to the methods described below.

At 202, method 200 may estimate engine operating conditions and ambient conditions. Estimating engine operating conditions may involve determining an estimated time until an engine-off condition. This may be determined via trip data provided by a vehicle operator via an on-board navigation system and/or a smart mobile device, in conjunction vehicle positional and speed information as determined by a GPS (such as GPS 80 of FIG. 1). Determining ambient conditions may involve estimating ambient temperature conditions via an ambient temperature sensor (not shown). Additionally or alternatively, ambient temperature may be estimated via local weather data obtained via a remote access to the internet through a cloud or smart mobile device, in conjunction with positional data obtained by the GPS. Fuel temperature may also be estimated. In one example, the fuel temperature may be determined by a fuel temperature sensor (not shown) internal to the fuel tank. In another example, fuel temperature may be determined by a fuel tank temperature sensor (such as temperature sensor 121 of FIG. 1).

Additionally, estimating engine operating conditions may involve determining the level of loading of a fuel vapor canister (such as fuel vapor canister 22 of FIG. 1) and a canister buffer (such as buffer 22*a* of FIG. 1). The fuel vapor canister load may be measured, estimated, or inferred. For example, canister load may be determined based on canister temperature change during a fuel tank venting event and/or a refueling event. In some examples, the canister load may be determined based on fuel composition, fuel RVP, fuel tank pressure, etc. A canister load may also be based on a quantity of fuel vapor desorbed during a prior canister purge event. Fuel vapor desorption may be determined based on canister temperature, hydrocarbon sensors, A/F ratio, exhaust oxygen levels, etc. Further, the canister load may be estimated based on a first time elapsed since an immediately previous purge event wherein fuel vapor from the canister was routed to the engine for combustion. The canister load is further estimated based on a duration of opening of the variable bleed valve (such as VBV 110 in FIG. 1) such as during a refueling event following the immediately previous purge event to allow flow of fuel vapor from the fuel tank to the canister thereby increasing canister load. Also, during purging, an estimated vapor amount/concentration can be used to determine the amount of fuel vapors stored in the canister, and then during a later portion of the purging operation (when the canister is sufficiently purged or empty), the estimated vapor amount/concentration can be used to estimate a loading state of the fuel vapor canister.

At 204, method 200 may determine whether an engine-off event is imminent. An imminent engine-off event may involve determining if an engine (such as engine 10 of FIG. 1) may be switched off within a threshold time. The threshold time may depend on how long it may take to warm up the canister heater to a threshold temperature required for desorption of fuel vapors from the canister, and how much charge remains in the battery. At engine-off, fuel injection and spark to engine cylinders (such as cylinders 30 of FIG. 1) may be suspended to suspend combustion in the cylinders. In one example, the engine-off event may be initiated due to switching from use of the engine to drive a vehicle system (such as vehicle system 6 of FIG. 1) to extended use of an electric machine (such as electric machine 153 of FIG. 1) in order to generate torque for the vehicle system during driving. Switching from driving the vehicle system by the engine to the electric machine may be performed by the control system, and may depend on external conditions such as road conditions (e.g. passing onto a continuous strip of smooth pavement), the amount charge in a battery (such as battery 158 of FIG. 1), and the amount of fuel in the fuel tank.

Additionally or alternatively, an engine-off event may be accompanied by a key-off event, such as after completion of a trip after which the vehicle is no longer propelled by engine torque or motor torque. The amount of time remaining in a trip before a key-off event may be determined by input of trip data by a vehicle operator into an on-board navigation system and/or smart device. The vehicle operator may input a destination in the navigation system, and the navigation system may determine a route to the destination and an expected time of travel. Based on the trip data input from the vehicle operator, the control system may determine if the trip will be completed within the threshold time. As described in relation to 204, the threshold time may depend on how long it may take to warm up the canister heater to a threshold temperature required for desorption of fuel vapors from the canister, and how much charge remains in the battery.

If it is determined that an engine-off event is not imminent, at 209 reverse purging may be postponed until conditions are met. Conditions met may involve an imminent engine-off event as described in 204, an ambient temperature being less than a fuel temperature to be discussed in more detail in relation to 206, and a canister load being greater than an upper canister load threshold, to be discussed in more detail in relation to 208.

If an engine-off event is imminent, then method 200 may proceed to 206 to determine if the ambient temperature is less than the fuel tank temperature. The ambient temperature and fuel tank temperature may be determined in 202. If the ambient temperature is less than the fuel tank temperature, upon engine shut-down, when the fuel system cools, fuel vapors in the fuel tank may be able to cool and condense back into liquid fuel, allowing a vacuum to form in the fuel tank. If the ambient temperature is determined to be greater than the fuel temperature, it may be inferred that upon engine shut down, the fuel vapors in the fuel tank may not be able to condense. Therefore, then method 200 proceed to 209 to postpone the purging process until ambient temperature decreases below the fuel temperature. Method 200 may then return to 206. If the ambient temperature is less than the temperature of the fuel in the fuel tank, then method 200 may proceed to 208.

At 208, method 200 may determine if the canister load is greater than an upper threshold level of loading of the fuel vapor canister. The upper threshold level of loading may be a pre-calibrated value, and may indicate a level of loading of the fuel vapor canister where cleaning of the fuel vapor canister may be desirable. The upper threshold may be pre-calibrated based on canister size, design, and capacity. Further, the upper threshold may be less than a purge loading level of the fuel vapor canister, where loading beyond the purge loading level may risk operation of the EVAP system with significant fuel vapor emissions. If the level of fuel vapor canister load is greater than or equal to the purge load level, the EVAP system may actively purge the fuel vapor canister 22, and not wait for a reverse purging event to take place. However, if the canister load is greater than an upper threshold and yet below the purge loading level, the controller may initiate reverse purging in order to maintain canister longevity and operation of the EVAP system. The canister load may be determined in 202. If it is determined that the canister load is less than the upper threshold, then method 200 may return to 209 to postpone reverse purging until the canister load is greater than the upper threshold. Method 200 may then return to 206 to determine if the ambient temperature is still less than the fuel temperature.

If it is determined that the loading of the canister is greater than the upper threshold, method 200 may proceed to 210 to switch on or maintain operation of a canister heating element to heat the fuel vapor canister. For example, a thermoelectric canister heater may be turned on in order to heat the interior of the fuel vapor canister. In some examples, wherein the canister heater comprises a heat transfer mechanism, a thermal carrier may be heated to a threshold temperature, and then circulated through a heat exchanger to warm the canister. In other words, operation of the heater is initiated prior to an engine-off event upon prediction of the engine-off event being imminent during a higher than threshold canister loading.

After canister heater operation is activated or maintained, method 200 may proceed to 212 to determine if an engine-off event is detected. An engine-off event may include the controller switching off the fuel injection via fuel injectors (such as fuel injectors 66 of FIG. 1), spark plugs (not shown), and a fuel pump (such as fuel pump 21 of FIG. 1). If an engine-off event is not detected, method 200 may proceed to 213 to maintain operation of the canister heating element, and return to 212 to continue waiting for an engine-off event. If an engine-off event is detected, method 200 may proceed to 214 of FIG. 2B to maintain operation of a powertrain control module (such as controller 12 of FIG. 1, which may be configured as a PCM) in order to facilitate fuel vapor canister reverse purging.

At 216, the PCM may actuate a variable bleed valve (such as VBV 110 in FIG. 1) to transition from an open position to a closed position to seal the fuel tank. As the engine and the fuel tank cool due to heat dissipation and a lower ambient temperature, the fuel vapors within the fuel tank may condense, thereby generating a vacuum in the fuel tank. Change in fuel tank pressure may be monitored via a fuel tank pressure sensor (such as pressure sensor 120 of FIG. 1).

At 218, method 200 may determine if a target vacuum threshold of the fuel system is achieved. The target vacuum may be a threshold value of pressure at which sufficient vacuum is developed in the fuel tank to draw in fuel vapor from the canister for a reverse purging event. As an example, the target vacuum may be −10 in. $H_2O$ in the fuel tank. If the fuel tank pressure does not reach the target vacuum level, method 200 may proceed to 219 to maintain the VBV closed until the target vacuum is achieved, after which method 200 may return to 218.

If the target vacuum of the fuel tank is achieved, then method 200 may proceed to 220, whereby the PCM may actuate the VBV from a closed position to an open position. Opening the VBV may fluidly couple the fuel tank to the atmosphere via an open canister vent valve (such as CVS valve 114 of FIG. 1).

With the VBV and canister vent valve open, method 200 may proceed to 222 to commence with a reverse purge of the fuel vapor canister into the fuel tank. During reverse purging, air may enter the fuel tank via a vent line (such as vent line 27 of FIG. 1) in response to the pressure difference between the atmosphere and the target level of vacuum maintained inside the fuel tank. As an example, with a vacuum in the tank of −10 in $H_2O$, fresh air may enter the fuel tank via the vent line and the canister at a rate of 1 liter/minute or higher. As the canister is heated, the previously adsorbed fuel vapors are desorbed, and the desorbed fuel vapor may flow to the fuel tank along with the fresh air entering the vent line. In this way, fuel vapor from the canister may be routed into the fuel tank as part of the reverse purging process.

At 224, method 200 may determine if an upper pressure threshold of the fuel system is achieved. The upper pressure threshold may be a pre-calibrated quantity based on atmospheric pressure, and the upper pressure threshold may be set in order to determine if sufficient pressure equilibration between atmospheric pressure and pressure in the fuel tank is achieved, such that maintaining the VBV open may lead to no further or insufficient reverse purging. As such, if the pressure in the fuel tank reaches the upper pressure threshold, fresh air may no longer be drawn in through the vent line, thereby suspending the flow of fuel vapors from the canister to the fuel tank. In one example, the upper pressure threshold may be set to atmospheric pressure. If the upper pressure threshold is not achieved, it may be inferred that there is still sufficient vacuum present in the fuel tank to draw in ambient air and fuel vapor from the canister and the method 200 may proceed to 225. At 225, the VBV may be maintained in the open position until the upper pressure threshold is achieved, and may then return to 224.

If the upper pressure of the fuel system is achieved, method 200 may proceed to 226 to determine if an updated canister load is below a lower threshold value of the canister load. The lower canister threshold is less than the upper canister threshold of 208. The lower canister threshold may be a pre-calibrated threshold, which may represent a threshold below which further purging of the canister load may not be desired. The updated canister load may be determined in several ways. For example, canister loading may be determined based on canister temperature change during the time interval between the initiation of the reverse purging event at 222 and the fuel system reaching the upper pressure threshold. In other examples, canister loading may be a function of one or more of the fuel vapor canister load at the initiation of the reverse purging, and the initial pressure at the fuel tank at the initiation of reverse purging. The current canister load may be based on a quantity of fuel vapor desorbed during a canister purge event. Fuel vapor desorption may be determined based on canister temperature, hydrocarbon sensors, A/F ratio, exhaust oxygen levels, etc. If the updated canister load is greater than the lower threshold load, it may be inferred that further reverse purging may be desired. The method 200 may then return to 214.

If it is determined that the updated canister load is below the lower threshold load, it may be inferred further reverse purging may not be desired, and method 200 may proceed to 228 to switch off the canister heater. Method 200 may proceed to 230 to close the VBV 110, thereby sealing off the fuel tank 20. Method 200 may then proceed to 232 to deactivate the PCM, and then method 200 may end.

Figure 3:
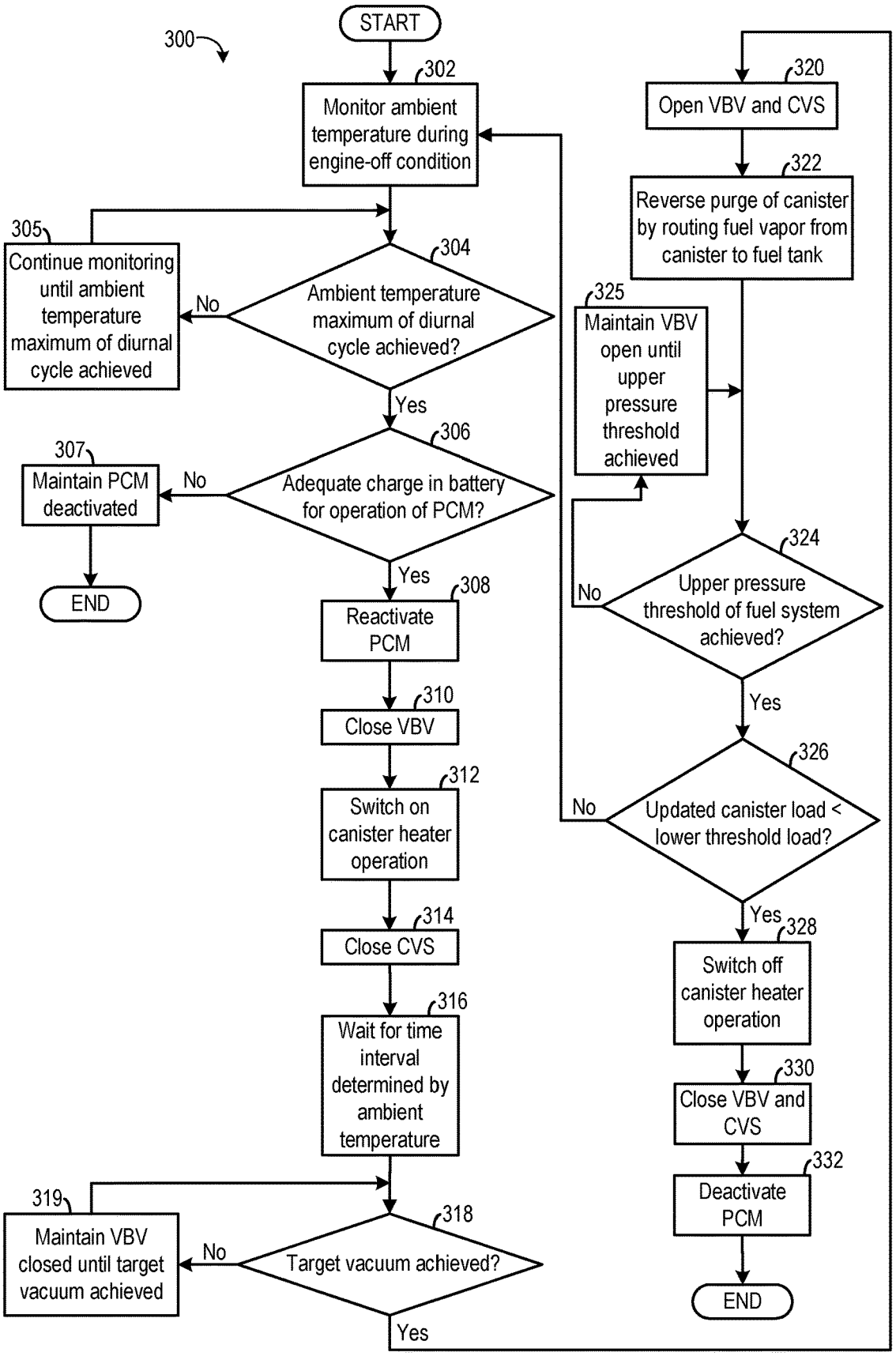
FIG. 3 shows a flowchart of an example method for heating the vapor fuel canister after a engine-off event to facilitate reverse purging of the fuel vapor canister.

FIG. 3 shows a flow chart of a method 300 for heating a vapor fuel canister (such as fuel vapor canister 22 of FIG. 1) during an engine-off event in response to an ambient temperature reaching a maxima of a diurnal temperature cycle in order to facilitate reverse purging of a fuel vapor canister. After reaching the maxima of the diurnal temperature cycle, liquid fuel contained in a fuel tank (such as fuel tank 20 of FIG. 1) may cool during a cool-off period of the diurnal temperature cycle.

At 302, method 300 may monitor the ambient temperature during an engine-off condition. In one example, ambient temperature may be monitored in real-time by an ambient temperature sensor (not shown) coupled to the vehicle. In one example, ambient temperature may be monitored via local weather data as obtained from an external source such as a network cloud via wireless communication. In another example, the local weather data may be forecast weather data retrieved by the controller from one or more internet web sites (e.g. National Weather Service). The forecast weather information retrieved may pertain to expected ambient temperature changes and weather conditions related to a diurnal cycle. For example, a diurnal cycle temperature variation may include a heat gain portion of the diurnal cycle, and a heat loss portion of the diurnal cycle. The heat gain portion may comprise a portion of the diurnal cycle where ambient temperatures are increasing, whereas the heat loss portion may comprise a portion of the diurnal cycle where ambient temperatures are decreasing. The controller may further determine an approximate time when temperature corresponding to the heat gain portion is greatest or maximal, and may also determine an approximate time when temperature corresponding to the heat loss portion is lowest, or minimal. Said another way, the controller may determine the approximate time when it is expected based on the forecast weather data that the heat gain portion of the diurnal cycle will switch or begin transitioning to a heat loss portion, and may further determine the approximate time when it is expected that the heat loss portion of the diurnal cycle will switch or begin transitioning to a heat gain portion. Such information may be stored at the controller.

At 304, method 300 may infer if a maximum of the ambient diurnal temperature cycle is reached. A maximum in the ambient diurnal temperature cycle may be inferred by determining if the ambient diurnal temperature cycle is approximately at the time of transitioning from a heat gain portion to a heat loss portion. In one example, the maximum temperature may be a local maxima such as the maximum temperature attained within a time frame (such as within six hours from engine shut-down) or the maximum temperature of the day. This transition time, as estimated from the forecast weather data in 302, may then be accessed from the controller, which may then actuate the system in response to the reaching the transition time. If the maximum of the ambient diurnal temperature cycle is not reached, then method 300 may proceed to 305, to continue monitoring the ambient temperature until the ambient temperature maximum of the ambient diurnal temperature cycle is achieved. Method 300 may then return to 304.

If it is determined that the maximum of the ambient diurnal temperature cycle is achieved, then method 300 may proceed to 306 to determine if there is adequate charge in a battery (such as battery 158 of FIG. 1) to proceed with a reverse purging event. The amount of charge in the battery may be stored in the memory of the controller, and an adequate amount of charge in the battery system may be determined based on the energy required to perform a reverse purging event, including operation of the PCM in a wake-up mode, opening and closing of valves, and operation of a canister heater (such as canister heater 24 of FIG. 1). If it is determined that there is inadequate charge, method 300 may proceed to 307 to maintain the PCM in a deactivated state and not perform a canister reverse purge event. Method 300 may then end.

If it is determined that there is adequate charge in the battery for initiating a reverse purge event, method 300 may proceed to 308 to reactivate the PCM. Reactivation of the PCM may involve switching the PCM from a sleep mode to a wake-up mode, which may allow for actuation of the canister heater and valves, such as a variable bleed valve (such as VBV 110 in FIG. 1) and a canister vent solenoid valve (such as CVS valve 114 in FIG. 1).

At 310, the PCM may actuate the VBV to transition from an open position to a closed position to seal the fuel tank. As the engine and the fuel tank cools due to heat dissipation and a lower ambient temperature, the fuel vapors within the fuel tank may condense, thereby generating vacuum in the fuel tank. Change in fuel tank pressure may be monitored via a fuel tank pressure sensor (such as pressure sensor 120 of FIG. 1).

At 312, method 300 may proceed to switch on heating of the fuel vapor canister via operation of the canister heating element. For example, a thermoelectric canister heater may be turned on in order to heat the interior of the fuel vapor canister. In some examples, wherein the canister heater comprises a heat transfer mechanism, a thermal carrier may be heated to a threshold temperature, and then circulated through a heat exchanger to warm the canister.

At 314, the PCM may actuate the CVS valve to transition from an open position to a closed position. Closing of the CVS valve may act to block air flow from the atmosphere to the fuel vapor canister, which may prevent cooling of the fuel vapor canister through fluid coupling to the atmosphere. Additionally, due to the VBV being in a closed position, the fuel vapor canister may be sealed, which may further accelerate heating thereof.

At 316, method 300 may wait for a time interval for vacuum generation. The time interval may be determined by the ambient temperature. Waiting for a time interval may serve two purposes. First, it may allow for continued heating of the fuel vapor canister by a canister heating element. Second, it may allow for development of a vacuum in the fuel tank, due to the cooling of the ambient temperature due the heat loss portion of the ambient diurnal temperature cycle. The time interval may be determined by the estimated ambient temperature maximum, in addition to the forecasted ambient diurnal temperature cycle. As an example, the time interval may be 5-10 minutes depending on the ambient temperature.

At 318, method 300 may determine if a target vacuum of a fuel system (such as fuel system 18 of FIG. 1) is achieved. The target vacuum may be a threshold value of pressure at which sufficient vacuum is developed in the fuel tank to draw in fuel vapor from the canister for a reverse purging event. As an example, the target vacuum may be −10 in. $H_2O$ in the fuel tank. If the fuel tank pressure does not reach the target vacuum level, method 300 may proceed to 319 to maintain the VBV closed until the target vacuum is achieved, after which method 300 may return to 318.

If the target vacuum of the fuel tank is achieved, then method 300 may proceed to 320, whereby the PCM may actuate each of the VBV and the CVS valve from a closed position to an open position. Opening each of the VBV and the CVS valve may fluidly couple the fuel tank to the atmosphere.

With the VBV and CVS valve open, method 300 may proceed to 322 to commence with a reverse purge of the fuel vapor canister into the fuel tank. Due to the target level of vacuum being achieved in 318, air may enter the fuel tank via a vent line (such as vent line 27 of FIG. 1) in response to the pressure difference between the atmosphere and the inside of the fuel tank. As an example, with a vacuum in the tank of −10 in. $H_2O$ and normal atmospheric pressure, fresh air may enter the fuel tank at a rate of 1 liter/minute or higher. Fresh air entering the fuel tank, in conjunction with canister heating as initiated in 312, may allow the desorption of hydrocarbons in the form of fuel vapor from the fuel vapor canister, which may then be routed into the fuel tank as part of the reverse purging process.

In other words, reverse purging the fuel vapor canister may include opening the VBV and CVS valve coupled to a vent line and routing ambient air to the fuel tank via the vent line, the heated canister, and a fuel vapor line (such as fuel vapor line 31 of FIG. 1), where the ambient air may flow desorbed fuel vapor from the canister to the fuel tank.

At 324, in method 300 may determine if an upper pressure threshold of the fuel system is achieved. The upper pressure threshold may be a pre-calibrated quantity based on atmospheric pressure, and may be set in order to determine if sufficient pressure equilibration between atmospheric pressure and pressure in the fuel tank is achieved, such that maintaining each of the VBV and CVS valve open may lead to no further or insufficient reverse purging. In one example, the upper pressure threshold may be set to atmospheric pressure. If the upper pressure threshold is not achieved, method 300 may proceed to 325 to maintain the VBV open until the upper pressure threshold is achieved, and may otherwise loop back to 324 to determine if the upper pressure threshold of the fuel system is achieved.

If the upper pressure of the fuel system is achieved, method 300 may proceed to 326 to determine if an updated canister load is below a lower threshold value. The lower canister threshold may be a pre-calibrated threshold, which may represent a threshold below which undesirable emissions may not be generated. The updated canister load may be determined in several ways. For example, canister loading may be determined based on canister temperature change during the time interval between the initiation of the reverse purging event at 322 and the fuel system reaching the upper pressure threshold. In other examples, canister loading may be determined based on fuel composition, fuel RVP, fuel tank pressure, etc. The current canister load may be based on a quantity of fuel vapor desorbed during a canister purge event. Fuel vapor desorption may be determined based on canister temperature, hydrocarbon sensors, A/F ratio, exhaust oxygen levels, etc. If the updated canister load is greater than the lower threshold load, method 300 may return to 302 to monitor the ambient temperature in order to re-initiate the method at the next occurrence of a maximum in the ambient diurnal temperature cycle.

If it is determined that the updated canister load is below the lower threshold load, then the fuel vapor canister may operate without generating undesirable emissions, and method 300 may proceed to 328 to switch off the canister heater. Method 300 may proceed to 330 to close the VBV and CVS valve, thereby sealing off the fuel system from the atmosphere. Method 300 may then proceed to 332 to deactivate the PCM, then method 300 may then end.

In this way, during an engine-off condition, a fuel tank may be sealed from a fuel vapor canister of an evaporative emissions control (EVAP) system, a heater coupled to the fuel vapor canister of the EVAP system may be operated, and upon a pressure in the fuel tank reaching a first threshold pressure, the fuel tank may be unsealed to enable reverse purging the fuel vapor canister. FIG. 4 shows a timeline 400 for initiating heating a fuel vapor canister (such as fuel vapor canister 22 of FIG. 1) prior to an engine-off event to facilitate a reverse purge of the fuel vapor canister. The horizontal (x-axis) denotes time and the vertical markers $t_1$-$t_4$ identify significant times in the diagnostic routines.

Timeline 400 includes a plot 402 of the operation of a powertrain control module (such as controller 12 of FIG. 1, which may be configured as a PCM). Maintaining operation of the PCM after an engine-off event may allow for initiation of a reverse purge event in conjunction with heating a fuel vapor canister. The reverse purge event utilizes operation of a variable bleed valve (such as VBV 110 of FIG. 1); operation of the VBV is given by plot 404. A successful reverse purge event lowers the load of the fuel vapor canister. The canister load is given by plot 406, and upper and lower thresholds for determining applicability of a reverse purge event are given by dashed line 408 and dashed line 410, respectively. The upper threshold as shown by dashed line 408 indicates a canister load level beyond which it is desirable to initiate reverse purging of the fuel vapor canister in order to maintain longevity and efficient operation of an EVAP system (such as EVAP system 19 of FIG. 1). The lower threshold as shown by dashed line 410 indicates a canister load level below which there is no need for further canister purging. The reverse purge of method 200 relies on use of a canister heater (such as canister heater 24 of FIG. 1); operation of the canister heater is given by plot 412.

A reverse purge event utilizes a pressure difference between the atmospheric pressure and the pressure of the fuel system (such as fuel system 18 of FIG. 1), relying on a vacuum to develop in the fuel tank (such as fuel tank 20 of FIG. 1) due to condensation of fuel vapor in the tank upon cooling. The fuel tank pressure is given by plot 416, while an upper pressure threshold for ending a reverse purge event and a target vacuum for initiating a reverse purging event are given by dashed line 414 and dashed line 418, respectively. The upper pressure threshold as shown by dashed line 414 indicates a pressure level in the fuel tank beyond which reverse purging is no longer effective, due to an insufficient pressure gradient between the fuel tank pressure and the atmospheric pressure. The target vacuum threshold as shown by dashed line 418 indicates a pressure level at which a reverse purge event will draw a sufficient amount of desorbed fuel vapors from the fuel vapor canister. As a reverse purge event happens after an engine-off event, engine operation of an engine system (such as engine system 8 of FIG. 1) is given by plot 420. A reverse purge event further relies on the ambient temperature to be less than the fuel tank temperature, in order for cooling in the fuel tank to occur, which causes fuel vapors to condense into liquid fuel, generating a vacuum in the fuel tank. The fuel tank temperature and ambient temperature are given on the same axes by plot 422 and dashed plot 424, respectively.

Prior to $t_1$, a vehicle system (such as vehicle system 6 of FIG. 1) is being driven by torque from the engine system; as such, the engine system is in operation. Concurrently, the PCM is in operation, and the VBV is in an open position. Consequently, due to the VBV being in an open position, the fuel tank pressure may be maintained around atmospheric pressure. Due to engine operation, operation of the canister heater may be maintained in an off position. The fuel tank temperature is unequilibrated with and greater than the ambient temperature due to operation of the engine, e.g. through heating of the fuel system by an engine exhaust (such as engine exhaust 25 of FIG. 1). Due to engine operation, the canister load will slightly increase, as shown in plot 406.

At $t_1$, the PCM determines that an engine-off event is imminent as determined by a trip data provided by a vehicle operator via an on-board navigation system and/or a smart mobile device, in conjunction vehicle positional and speed information as determined by a GPS (such as GPS 80 of FIG. 1). Additionally, it is determined that the ambient temperature is less than the fuel tank temperature, and the canister load is greater than an upper threshold load, fulfilling the conditions for a reverse purging event to commence. In response to an imminent engine-off event and the conditions for a reverse purging event being satisfied, a canister heater is switched on, in order to heat the vapor fuel canister in preparation for a reverse purge event after an engine-off event is achieved. From $t_1$ to $t_2$, the vehicle may be driven for the remainder of the trip using engine torque while canister heating is being carried out.

At $t_2$, in response to an engine-off event, engine operation is discontinued. After the engine-off event, the PCM is maintained active, in order to execute the reverse purging event. In response to the engine-off event, the PCM actuates the VBV from an open position to a closed position, in order to seal off the fuel tank and allow a vacuum to develop in the fuel tank due to cooling of fuel vapors stored therein. From $t_2$ to $t_3$, in response to the ambient temperature being less than the fuel tank temperature and the VBV, the fuel vapor condenses causing the pressure in the fuel tank to drop. Concurrently with the pressure drop, the fuel tank temperature also drops, as fuel vapors condense in the fuel tank. Throughout the period between $t_2$ to $t_3$, the fuel tank temperature remains above the ambient temperature. Additionally from $t_2$ to $t_3$, as there is no engine activity, the canister load remains constant.

At $t_3$, the pressure in the fuel tank reaches the target vacuum level for initiating a reverse purge event. In response to the pressure in the fuel tank reaching a target vacuum level, the PCM actuates the VBV from a closed position to an open position, fluidly coupling the fuel tank to the atmosphere. From $t_3$ to $t_4$, the reverse purge event is underway. Due to the heating of the fuel vapor canister by the canister heater from time $t_1$ to time $t_3$, the canister is hot enough to allow for desorption of fuel vapors from the adsorbent stored in the fuel vapor canister. Due to the pressure difference between fuel tank and the atmosphere, fresh air flows in from the atmosphere via a vent line (such as vent line 27 of FIG. 1) through the fuel vapor canister into the fuel tank. The combination of the air flow through the fuel vapor canister in conjunction with the heating of the fuel vapor canister causes the stored fuel vapors to be reverse purged from the fuel vapor canister into the fuel tank. The reverse purge of stored fuel vapors from the fuel vapor canister into the fuel tank is indicated by the canister load decreasing, in addition to an increase in the fuel tank pressure. In between $t_3$ and $t_4$, due to the reverse purging of the canister, the canister load decreases to below the lower canister threshold, indicating that the reverse purging event was successful.

At $t_4$, due to equilibration of pressure between the fuel tank and the atmosphere, the pressure in the fuel tank reaches the upper pressure threshold for concluding a reverse purge event. In response to the pressure in the fuel tank reaching the upper pressure threshold, the PCM switches operation of the canister heater from an on position to an off position. Subsequently, the PCM switches the VBV from an open position to a closed position, thereby isolating the fuel tank from the atmosphere. Due to the reverse purge event concluding, the PCM may return to a power off position, and the method ends.

FIG. 5 shows a timeline 500 for initiating heating a fuel vapor canister (such as fuel vapor canister 22 of FIG. 1) after an engine-off event as part of a reverse purge of the fuel vapor canister, in response to reaching a maximum of an ambient diurnal temperature cycle. The horizontal (x-axis) denotes time and the vertical markers $t_1$-$t_3$ identify significant times in the diagnostic routines.

Timeline 500 includes a plot 502 of the operation of a powertrain control module (such as controller 12 of FIG. 1, which may be configured as a PCM). Maintaining operation of the PCM after an engine-off event may allow for initiation of a reverse purge event in conjunction with heating a fuel vapor canister. The reverse purge event utilizes operation of a variable bleed valve (such as VBV 110 of FIG. 1) and operation of a canister vent solenoid valve (such as CVS valve 114 of FIG. 1); operation of the VBV and CVS valve are given by plots 504 and 506, respectively. A successful reverse purge event lowers the load of the fuel vapor canister. The canister load is given by plot 508, and upper and lower thresholds for determining applicability of a reverse purge event are given by dashed line 510 and dashed line 512, respectively. The upper threshold as shown by dashed line 510 indicates a canister load level beyond which it is desirable to initiate reverse purging of the fuel vapor canister in order to maintain longevity and efficient operation of an EVAP system (such as EVAP system 19 of FIG. 1). The lower threshold as shown by dashed line 512 indicates a canister load level below which there is no need for further canister purging. The reverse purge of method 300 relies on use of a canister heater (such as canister heater 24 of FIG. 1); operation of the canister heater is given by plot 514.

A reverse purge event utilizes a pressure difference between the atmospheric pressure and the pressure of the fuel system (such as fuel system 18 of FIG. 1), relying on a vacuum to develop in the fuel tank (such as fuel tank 20 of FIG. 1). The fuel tank pressure is given by plot 518, while an upper pressure threshold for ending a reverse purge event and a target vacuum for initiating a reverse purging event are given by dashed line 516 and dashed line 520, respectively. The upper pressure threshold as shown by dashed line 516 indicates a pressure level in the fuel tank beyond which reverse purging is no longer effective, due to an insufficient pressure gradient between the fuel tank pressure and the atmospheric pressure. The target vacuum as shown by dashed line 520 indicates a pressure level at which a reverse purge event will draw a sufficient amount of desorbed fuel vapors from the fuel vapor canister. A reverse purge event further relies on the ambient temperature to be less than the fuel tank temperature, in order for cooling in the fuel tank to occur, which causes fuel vapors to condense into liquid fuel, generating a vacuum in the fuel tank. The fuel tank temperature and ambient temperature are given by plot 522 and plot 526, respectively.

Further, the method 300 monitors the ambient diurnal temperature cycle for a maximum temperature value; the maximum of the ambient diurnal temperature cycle is given by dashed line 524. As method 300 operates after an engine-off event, sufficient energy stored in a battery (such as battery 158 of FIG. 1) is required in order to initiate heating of the canister and actuation of the VBV and CVS valve; the battery charge is shown by plot 528, with the minimum battery charge level required to initiate method 300 given by dashed line 530.

Prior to $t_1$, the engine is in an engine-off state, and the ambient temperature is being monitored via forecast weather data retrieved via access to the internet, e.g. through access to a cloud. Due to the engine being in an off state, the PCM is maintained in an off state, in addition to the operation of the heater. Due to the engine being in an off-state, the canister loading level is maintained constant. Additionally, due to the engine being in an off-state, the battery level is also maintained constant. The CVS valve and the VBV are maintained in an open position, causing equilibration of the fuel tank pressure with the atmosphere. A maximum in the ambient diurnal temperature cycle is inferred from the forecast weather data, and an approximate time to reach the maximum is given, after which the PCM will be switched from an off state to an on state. Due to the increase of the ambient temperature, the fuel tank temperature also increases.

At $t_1$, the ambient temperature maximum is achieved as according to the forecast weather data, and the PCM is switched from an off state to an on state. The PCM, in response to the maximum in the ambient temperature cycle being reached, actuates the VBV and the CVS valve from open states to closed states. Closing of the VBV and the CVS valve acts to seal off the fuel vapor canister from the fuel tank and the atmosphere, providing a greater degree of thermal isolation. Further, closing of the VBV serves to seal off the fuel tank. In conjunction with closing of the VBV and CVS valve, operation of the canister heater is switched from an off state to an on state. The thermal isolation of the fuel vapor canister acts to accelerate heating of the fuel vapor canister due to operation of the canister heater. From $t_1$ to $t_2$, the PCM waits for a time interval determined by the ambient temperature. Due to the ambient temperature being at a maximum of the ambient diurnal temperature cycle at $t_1$, after $t_1$ the ambient temperature starts to decrease, as part of the heat loss portion of the ambient diurnal temperature cycle. From $t_1$ to $t_2$, in response to the cooling of the ambient temperature, the fuel tank temperature also drops. Consequently, from $t_1$ to $t_2$ the pressure in the fuel tank also drops, as the fuel vapors contained within the fuel tank condense into liquid fuel. Additionally from $t_1$ to $t_2$, due to operation of the PCM, the canister heater and actuation of the VBV and CVS valve, the battery charge decreases.

At $t_2$, due to cooling of fuel vapors in the fuel tank in response to the cooling ambient temperature, the pressure in the fuel tank reaches the target vacuum. In response to the fuel tank pressure reaching the target vacuum, the PCM actuates the VBV and CVS valve from closed states to open states. Due to the heating of the fuel vapor canister by the canister heater from time $t_1$ to time $t_2$, the canister is hot enough to allow for desorption of fuel vapors from the adsorbent stored in the fuel vapor canister. Additionally, due to the pressure difference between fuel tank and the atmosphere, fresh air flows in from the atmosphere via a vent line (such as vent line 27 of FIG. 1) through the fuel vapor canister into the fuel tank. The combination of the air flow through the fuel vapor canister in conjunction with the heating of the fuel vapor canister causes the stored fuel vapors to be reverse purged from the fuel vapor canister into the fuel tank. The reverse purge of stored fuel vapors from the fuel vapor canister into the fuel tank is indicated by the canister load decreasing, in addition an increase in the fuel tank pressure. In between $t_2$ and $t_3$, due to the reverse purging of the canister, the canister load decreases to below the lower canister threshold, indicating that the reverse purging event was successful. Additionally, from $t_2$ to $t_3$, due to continued operation of the PCM, actuation of the VBV and CVS valve, and operation the canister heater, the battery charge continues to decrease.

At $t_3$, the pressure in the fuel tank reaches the upper pressure threshold. In response to the pressure in the fuel tank reaching the upper pressure threshold and due to the canister load reaching the lower threshold load, the PCM switches the canister heater from an on state to an off state. Subsequently, the PCM switches the CVS valve and VBV from open positions to closed positions, thereby isolating the fuel tank from the atmosphere. Due to the reverse purge event concluding, the PCM may return to a power off position, and the method ends.

In this way, through opportunistic utilization of ambient temperature cooling in conjunction with canister heating both before and after an engine-off event, efficient reverse purging may be achieved. In one example, in using a heated canister in conjunction with ambient temperature cooling to generate flow through the vapor fuel canister, more effective desorption of fuel vapors, in particular heavier hydrocarbons, stored in the canister may be achieved. Additionally, in the methods disclosed herein, there is no external power source in order to initiate canister heating, allowing for a completely remote method for reverse purging. An efficient reverse purging routine may allow for extended longevity of the fuel vapor canister, and may allow for design of vehicles with smaller fuel vapor canisters, reducing material and weight costs.

The disclosure provides support for a method for an engine in a vehicle, comprising: prior to an upcoming engine-off condition, heating a fuel vapor canister, and sealing a fuel tank, and in response to a pressure in the fuel tank reducing to a first threshold pressure, initiating reverse purging of the fuel vapor canister. In a first example of the method, heating of the fuel vapor canister is carried out via operation of a canister heater upon conditions for the reverse purging being met, the conditions including a temperature of the fuel tank being higher than an ambient temperature and a fuel vapor load within the fuel vapor canister being higher than a threshold load. In a second example of the method, optionally including the first example, sealing of the fuel tank includes closing a variable bleed valve (VBV) coupled to a fuel vapor line connecting the fuel vapor canister to the fuel tank. In a third example of the method, optionally including one or both of the first and second examples after engine shut-down, the reverse purging of the fuel vapor canister includes, opening the VBV, and drawing in air into the fuel tank via a vent line and the fuel vapor canister, the air desorbing fuel vapor from the fuel vapor canister and routing the desorbed fuel vapor to the fuel tank. In a fourth example of the method, optionally including one or more or each of the first through third examples, the method further comprises: during the reverse purging, in response to the pressure in the fuel tank increasing to above a second threshold pressure and the fuel vapor load within the fuel vapor canister remaining higher than the threshold load, maintaining the heating of the fuel vapor canister, resealing the fuel tank, and then in response to the pressure in the fuel tank again reducing to the first threshold pressure, repeating the reverse purging of the fuel vapor canister. In a fifth example of the method, optionally including one or more or each of the first through fourth examples, the second threshold pressure is higher than the first threshold pressure, the second threshold pressure being a function of atmospheric pressure and the first threshold pressure being lower than the atmospheric pressure. In a sixth example of the method, optionally including one or more or each of the first through fifth examples, the method further comprises: upon carrying out reverse purging one or more times and a load within in the fuel vapor canister reducing to below a threshold load, deactivating a canister heater and maintaining a VBV open. In a seventh example of the method, optionally including one or more or each of the first through sixth examples, the method further comprises: if a fuel vapor load within the fuel vapor canister is higher than a threshold load, during the engine-off condition, monitoring an ambient temperature, and upon the ambient temperature increasing to a maximum of a diurnal temperature cycle, initiating heating of the fuel vapor canister via operation of a canister heater. In an eighth example of the method, optionally including one or more or each of the first through seventh examples, during the heating of the fuel vapor canister, closing each of the VBV and a canister vent solenoid (CVS) valve coupled to a vent line. In a ninth example of the method, optionally including one or more or each of the first through eighth examples, the method further comprises: in response to the pressure in the fuel tank reducing to the first threshold pressure, opening each of the VBV and the CVS valve, and initiating the reverse purging of the fuel vapor canister.

The disclosure also provides support for a method for an engine in a vehicle, comprising: during an engine-off condition, sealing a fuel tank from a fuel vapor canister of an evaporative emissions control (EVAP) system, operating a heater coupled to the fuel vapor canister of the EVAP system, and upon a pressure in the fuel tank reaching a first threshold pressure, unsealing the fuel tank and reverse purging the fuel vapor canister. In a first example of the method, operation of the heater is initiated prior to an engine-off event upon prediction of the engine-off event being imminent during a higher than threshold fuel vapor canister loading. In a second example of the method, optionally including the first example, the engine-off event being imminent is predicted based on input from an on-board navigation system. In a third example of the method, optionally including one or both of the first and second examples, the operation of the heater is initiated during the engine-off condition upon an ambient temperature increasing to a maximum temperature of a diurnal cycle during the higher than the threshold fuel vapor canister loading. In a fourth example of the method, optionally including one or more or each of the first through third examples, sealing the fuel tank includes closing a variable bleed valve (VBV) coupled to a fuel vapor line connecting the fuel vapor canister to the fuel tank and unsealing the fuel tank includes opening the VBV. In a fifth example of the method, optionally including one or more or each of the first through fourth examples, reverse purging the fuel vapor canister includes, opening a canister vent solenoid (CVS) valve coupled to a vent line of the EVAP system and routing ambient air to the fuel tank via the vent line, the fuel vapor canister, and the fuel vapor line, the ambient air flowing desorbed fuel vapor from the fuel vapor canister to the fuel tank. In a sixth example of the method, optionally including one or more or each of the first through fifth examples, the method further comprises: during reverse purging of the fuel vapor canister, in response to the pressure in the fuel tank increasing to second threshold pressure during the higher than threshold fuel vapor canister loading, resealing the fuel tank, and upon the pressure in the fuel tank reducing to the first threshold pressure, unsealing the fuel tank, and repeating reverse purging the fuel vapor canister.

The disclosure also provides support for a system for an engine in a vehicle, comprising: a controller with computer-readable instructions stored on non-transitory memory that when executed cause the controller to: upon conditions for reverse purging of a fuel vapor canister of an evaporative emissions control (EVAP) system being met, close variable bleed valve (VBV) coupled to a fuel vapor line connecting the fuel vapor canister to a fuel tank, activate a heater coupled to the fuel vapor canister to desorb fuel vapor stored in the fuel vapor canister, and in response to a pressure in the fuel tank reducing to below a threshold pressure, open the VBV, and route ambient air to the fuel tank via a vent line of the EVAP system and the fuel vapor canister, the ambient air routing desorbed fuel vapor to the fuel tank. In a first example of the system, the conditions for the reverse purging include each of an upcoming engine-off condition, a temperature of the fuel tank being higher than an ambient temperature, and a load in the fuel vapor canister being higher than a threshold load, the reverse purging carried out during an engine-off condition. In a second example of the system, optionally including the first example, the conditions for the reverse purging further include a maximum of a diurnal temperature cycle during the engine-off condition and the load in the fuel vapor canister being higher than the threshold load.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine in a vehicle, comprising:

during an engine-off condition, sealing a fuel tank from a fuel vapor canister of an evaporative emissions control (EVAP) system by closing a variable bleed valve positioned between the fuel tank and the fuel vapor canister, operating a heater coupled to the fuel vapor canister of the EVAP system, and upon a pressure in the fuel tank reaching a target vacuum level, unsealing the fuel tank and reverse purging the fuel vapor canister, the target vacuum level being a vacuum level that draws fuel vapor from the fuel vapor canister to the fuel tank, wherein the pressure in the fuel tank is measured by a fuel tank pressure sensor.

2. The method of claim 1, wherein operation of the heater is initiated prior to an engine-off event upon prediction of the engine-off event during a higher than threshold fuel vapor canister loading.

3. The method of claim 2, wherein the engine-off event being imminent is predicted based on input from an on-board navigation system.

4. The method of claim 2, wherein the operation of the heater is initiated during the engine-off condition upon an ambient temperature increasing to a maximum temperature of a diurnal cycle during the higher than the threshold fuel vapor canister loading, the ambient temperature measured by an ambient temperature sensor.

5. The method of claim 1, wherein sealing the fuel tank includes closing a variable bleed valve (VBV) coupled to a fuel vapor line connecting the fuel vapor canister to the fuel tank and unsealing the fuel tank includes opening the VBV.

6. The method of claim 5, wherein reverse purging the fuel vapor canister includes, opening a canister vent solenoid (CVS) valve coupled to a vent line of the EVAP system and routing ambient air to the fuel tank via the vent line, the fuel vapor canister, and the fuel vapor line, the ambient air flowing desorbed fuel vapor from the fuel vapor canister to the fuel tank.

7. The method of claim 1, further comprising, during reverse purging of the fuel vapor canister, in response to the pressure in the fuel tank increasing to a threshold pressure during the higher than threshold fuel vapor canister loading, resealing the fuel tank, and upon the pressure in the fuel tank reducing to the target vacuum level, unsealing the fuel tank, and repeating reverse purging the fuel vapor canister.

* * * * *